US012426663B2

(12) United States Patent
Dealey

(10) Patent No.: US 12,426,663 B2
(45) **Date of Patent: *Sep. 30, 2025**

(54) UPPER FOR AN ARTICLE OF FOOTWEAR WITH FIRST AND SECOND KNITTED PORTIONS

(71) Applicant: NIKE, Inc., Beaverton, OR (US)

(72) Inventor: Stuart W. Dealey, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/408,168

(22) Filed: Aug. 20, 2021

(65) Prior Publication Data

US 2021/0378348 A1 Dec. 9, 2021

Related U.S. Application Data

(63) Continuation of application No. 15/969,994, filed on May 3, 2018, now Pat. No. 11,375,767.
(Continued)

(51) Int. Cl.
*A43B 1/04* (2022.01)
*A43B 9/00* (2006.01)
(Continued)

(52) U.S. Cl.
CPC ..... *A43B 1/04* (2013.01); *A43B 9/00* (2013.01); *A43B 23/0215* (2013.01);
(Continued)

(58) Field of Classification Search
CPC ..... A43B 1/04; A43B 23/0295; A43B 23/26; A43B 23/0215; A43B 9/00; D04B 1/22;
(Continued)

(56) References Cited

U.S. PATENT DOCUMENTS 5,604,997 A 2/1997 Dieter
5,778,473 A 7/1998 Chen
(Continued)

FOREIGN PATENT DOCUMENTS

CN 2358717 Y 1/2000
CN 1625352 A 6/2005
(Continued)

OTHER PUBLICATIONS

Extended European Search Report received for European Patent Application No. 21189694.9, mailed on Dec. 23, 2021, 9 pages.
(Continued)

*Primary Examiner* — Aiying Zhao
(74) *Attorney, Agent, or Firm* — Shook, Hardy & Bacon L.L.P.

(57) ABSTRACT

An upper may include a first knitted portion configured to form an outer surface of the upper, a second knitted portion configured to form an inner surface of the upper, where the second knitted portion is at least partially coextensive with the first knitted portion, an interstitial space between the first knitted portion and the second knitted portion, and a knitted connection structure connecting the first knitted portion to the second knitted portion. The knitted connection structure may extend at least partially along at least one of a tongue and a collar of the upper, and the second knitted portion may include at least one double jersey knit structure that is coextensive with the first knitted portion.

18 Claims, 8 Drawing Sheets

Related U.S. Application Data

(60) Provisional application No. 62/502,264, filed on May 5, 2017.

(51) Int. Cl.
*A43B 23/02* (2006.01)
*A43B 23/26* (2006.01)
*D04B 1/22* (2006.01)
*D04B 1/24* (2006.01)

(52) U.S. Cl.
CPC ..... *A43B 23/0295* (2013.01); *A43B 23/26* (2013.01); *D04B 1/22* (2013.01); *D04B 1/24* (2013.01); *D10B 2403/023* (2013.01); *D10B 2403/032* (2013.01); *D10B 2501/043* (2013.01); *D10B 2501/061* (2013.01)

(58) Field of Classification Search
CPC ..... D10B 2403/032; D10B 2501/061; D10B 2403/023; D10B 2501/043
USPC ..... 35/45, 47, 49, 55; 36/45, 47, 49, 55
See application file for complete search history.

(56) References Cited

U.S. PATENT DOCUMENTS

| | | | | |
|---|---|---|---|---|
| 8,448,474 | B1 * | 5/2013 | Tatler | A43C 5/00 66/64 |
| 8,595,878 | B2 | 12/2013 | Huffa et al. | |
| 9,072,335 | B1 | 7/2015 | Podhajny | |
| 9,145,629 | B2 | 9/2015 | Podhajny | |
| 9,365,960 | B2 * | 6/2016 | Craig | D04B 1/26 |
| 9,861,160 | B2 | 1/2018 | Podhajny et al. | |
| 9,970,134 | B2 | 5/2018 | Baines et al. | |
| 10,022,257 | B2 | 7/2018 | Higgins | |
| 10,316,441 | B2 | 6/2019 | Ly | |
| 10,327,498 | B2 | 6/2019 | Burch | |
| 10,568,382 | B2 | 2/2020 | Hatfield et al. | |
| 10,718,074 | B2 | 7/2020 | Hipp et al. | |
| 10,750,794 | B2 | 8/2020 | Van Tiel et al. | |
| 10,865,504 | B2 | 12/2020 | Dua et al. | |
| 2003/0033838 | A1 * | 2/2003 | Ikenaga | D04B 21/16 66/196 |
| 2003/0106346 | A1 | 6/2003 | Matsumoto | |
| 2010/0287790 | A1 | 11/2010 | Sokolowski et al. | |
| 2012/0233882 | A1 | 9/2012 | Huffa et al. | |
| 2012/0285043 | A1 * | 11/2012 | Dua | D04B 1/22 12/142 R |
| 2013/0239625 | A1 | 9/2013 | Tatler et al. | |
| 2014/0137433 | A1 * | 5/2014 | Craig | A43B 5/06 66/170 |
| 2014/0237861 | A1 | 8/2014 | Podhajny | |
| 2014/0245545 | A1 * | 9/2014 | Meir | D04B 1/12 66/170 |
| 2014/0310983 | A1 * | 10/2014 | Tamm | A43B 23/024 36/83 |
| 2014/0352173 | A1 | 12/2014 | Bell et al. | |
| 2015/0075031 | A1 | 3/2015 | Podhajny et al. | |
| 2015/0107307 | A1 * | 4/2015 | Kosui | A43B 17/003 2/239 |
| 2015/0128449 | A1 | 5/2015 | Lin et al. | |
| 2015/0216257 | A1 | 8/2015 | Meir et al. | |
| 2015/0313316 | A1 * | 11/2015 | Boucher | D04B 1/16 36/93 |
| 2015/0351483 | A1 | 12/2015 | Podhajny | |
| 2015/0359290 | A1 | 12/2015 | Podhajny et al. | |
| 2016/0095377 | A1 | 4/2016 | Tamm | |
| 2016/0213097 | A1 | 7/2016 | Uchikawa et al. | |
| 2017/0181501 | A1 | 6/2017 | Gautier et al. | |
| 2017/0311672 | A1 * | 11/2017 | Hipp | D04B 1/26 |
| 2017/0370027 | A1 | 12/2017 | Da Costa Pereira Machado et al. | |
| 2018/0042340 | A1 * | 2/2018 | Kuo | D04B 1/106 |
| 2018/0168271 | A1 * | 6/2018 | Ly | A43B 23/042 |
| 2018/0317593 | A1 | 11/2018 | Dealey | |
| 2019/0208862 | A1 | 7/2019 | Poegl et al. | |
| 2019/0335857 | A1 | 11/2019 | Huffa et al. | |
| 2020/0029647 | A1 | 1/2020 | Unnewehr et al. | |
| 2020/0170330 | A1 | 6/2020 | Verfl et al. | |
| 2020/0221826 | A1 | 7/2020 | Dua et al. | |
| 2021/0052039 | A1 | 2/2021 | Johnson et al. | |

FOREIGN PATENT DOCUMENTS

| | | | |
|---|---|---|---|
| CN | 201491780 | U | 6/2010 |
| CN | 103687507 | A | 3/2014 |
| CN | 104473376 | A | 4/2015 |
| CN | 104486959 | A | 4/2015 |
| CN | 105264133 | A | 1/2016 |
| CN | 204994752 | U | 1/2016 |
| CN | 106037119 | A | 10/2016 |
| EP | 2649898 | A1 | 10/2013 |
| EP | 2805638 | A1 | 11/2014 |
| WO | 2014/134247 | A1 | 9/2014 |
| WO | 2020142357 | A1 | 7/2020 |

OTHER PUBLICATIONS

Extended European Search Report received for European Patent Application No. 21189695.6, mailed on Dec. 23, 2021, 9 pages.
Santoni X-MACHINE for 3D shoe uppers on show at ISPO, Knitting Industry; Available online at: <https://www.knittingindustry.com/santoni-xmachine-for-3d-shoe-uppers-on-show-at-ispo/>, Jan. 28, 2020, 2 pages.
Wool Footwear—Knitted Upper, Product Innovations; Available online at: <https://www.woolmark.com/industry/use-wool/product-innovations/wool-knitted-upper/>, 3 pages.
Notice of Allowance received for U.S. Appl. No. 15/969,994, mailed on Mar. 2, 2022, 8 pages.
Final Office Action received for U.S. Appl. No. 15/969,994, mailed on Nov. 9, 2021, 18 pages.
Intention to Grant received for European Patent Application No. 21189694.9, mailed on Apr. 28, 2023, 6 pages.
Office Action received for European Patent Application No. 21189695.6, mailed on Mar. 29, 2023, 7 pages.
Final Office Action received for U.S. Appl. No. 17/840,135, mailed on May 14, 2024, 16 pages.
Non-Final Office Action received for U.S. Appl. No. 17/840,135, mailed on Feb. 6, 2024, 12 pages.
Non-Final Office Action received for U.S. Appl. No. 17/840,135, mailed on Sep. 10, 2024, 18 pages.
Notice of Allowance received for U.S. Appl. No. 17/840,135, mailed on Mar. 24, 2025, 8 pages.

* cited by examiner

FIG. 8
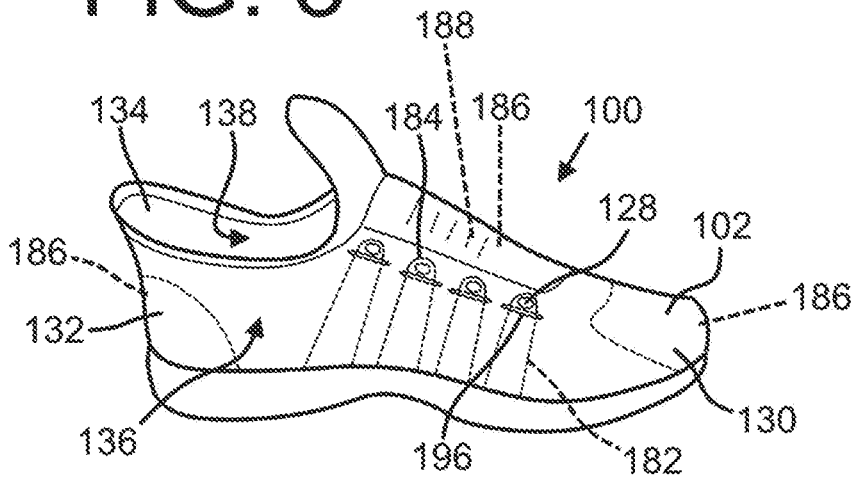
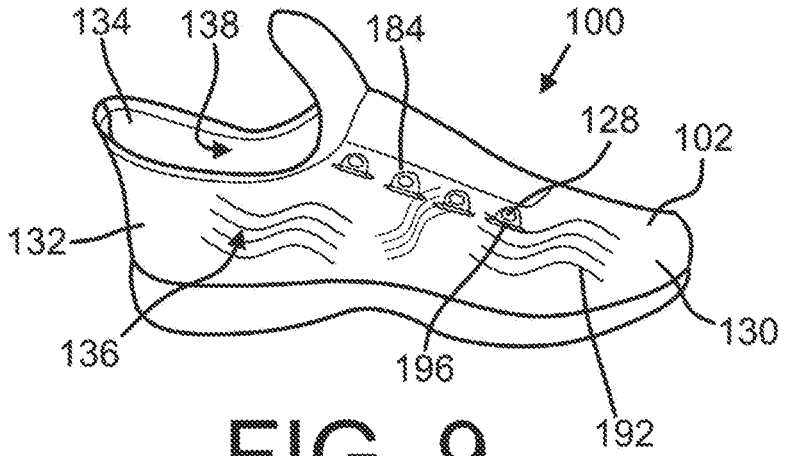
FIG. 9

UPPER FOR AN ARTICLE OF FOOTWEAR WITH FIRST AND SECOND KNITTED PORTIONS

CROSS-REFERENCE TO RELATED APPLICATIONS

This application is a continuation of U.S. patent application Ser. No. 15/969,994, filed May 3, 2018, and titled "Upper for an Article of Footwear with First and Second Knitted Portions," which claims priority to U.S. Provisional Patent App. No. 62/502,264, filed May 5, 2017, and titled "Upper for an Article of Footwear with First and Second Knitted Portions." The aforementioned applications are each incorporated herein by reference in their entirety.

BACKGROUND

Conventional articles of footwear generally include two primary elements: an upper and a sole structure. The upper is secured to the sole structure and forms a void within the article of footwear for comfortably and securely receiving a foot. The sole structure is secured to a lower surface of the upper so as to be positioned between the upper and the ground. In some articles of footwear, the sole structure may include a midsole and an outsole. The midsole may be formed from a polymer foam material that attenuates ground reaction forces to lessen stresses upon the foot and leg during walking, running, and other ambulatory activities. The outsole may be secured to a lower surface of the midsole and forms a ground-engaging portion of the sole structure that is formed from a durable and wear-resistant material.

The upper of the article of footwear generally extends over the instep and toe areas of the foot, along the medial and lateral sides of the foot, and around the heel area of the foot. An ankle opening in a heel area generally provides access to the void in the interior of the upper. A lacing system is often incorporated into the upper to adjust the fit of the upper, thereby facilitating entry and removal of the foot from the void within the upper. The upper may include a tongue that extends under the lacing system to enhance adjustability of the footwear, and the upper may incorporate a heel counter to limit movement of the heel.

BRIEF SUMMARY

One general aspect of the present disclosure includes an upper with a first knitted portion configured to form an outer surface of the upper, a second knitted portion configured to form an inner surface of the upper, where the second knitted portion is at least partially coextensive with the first knitted portion, an interstitial space between the first knitted portion and the second knitted portion, and a knitted connection structure connecting the first knitted portion to the second knitted portion. The knitted connection structure may extend at least partially along at least one of a tongue and a collar of the upper, and the second knitted portion may include at least one double jersey knit structure that is coextensive with the first knitted portion.

Another general aspect of the present disclosure includes an upper for an article of footwear, the upper having a first knitted portion forming an outer surface of the upper, a second knitted portion forming an inner surface of the upper, and a connection structure securing the first knitted portion with the second knitted portion. The connection structure may include at least one loop incorporated into a course of the first knitted portion and at least one loop incorporated into a course of the second knitted portion, where the second knitted portion may include at least one double jersey knit structure that is coextensive with the first knitted portion.

Another general aspect of the present disclosure involves a method of forming an upper, the method including the steps of knitting a first knitted portion configured to form an outer surface of the upper, knitting a second knitted portion configured to form an inner surface facing a void formed by the upper, and knitting a connection structure connecting the first knitted portion to the second knitted portion. The connection structure may extend at least partially along at least one of a tongue and a collar of the upper, and the second knitted portion may include at least one double jersey knit structure that is coextensive with the first knitted portion.

BRIEF DESCRIPTION OF THE DRAWINGS

FIG. 8 is an illustration showing the upper of FIG. 2 when incorporated into an article of footwear with hidden elements shown in dashed lines.

FIG. 9 is an illustration showing, without hidden lines, the upper of FIG. 2 when incorporated into an article of footwear.

DETAILED DESCRIPTION

Figure 1:
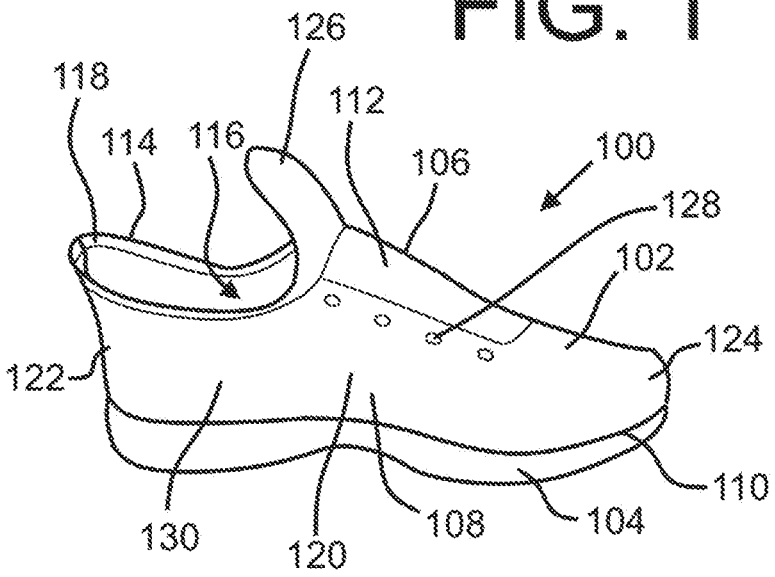
FIG. 1 is an illustration showing an article of footwear formed with an upper, the upper including a knitted component in accordance with an embodiment of the present disclosure.

Various aspects are described below with reference to the drawings in which like elements generally are identified by like numerals. The relationship and functioning of the various elements of the aspects may better be understood by reference to the following detailed description. However, aspects are not limited to those illustrated in the drawings or explicitly described below. It also should be understood that the drawings are not necessarily to scale, and in certain instances details may have been omitted that are not necessary for an understanding of aspects disclosed herein, such as conventional fabrication and assembly.

Certain aspects of the present disclosure relate to articles at least partially formed from textile materials. An example of an article is an article of apparel (e.g., shirts, pants, socks, footwear, jackets and other outerwear, briefs and other undergarments, hats and other headwear, or the like). One particular article is an upper configured for use in an article of footwear. The upper may be used in connection with any type of footwear. Illustrative, non-limiting examples of articles of footwear include a basketball shoe, a biking shoe, a cross-training shoe, a global football (soccer) shoe, an American football shoe, a bowling shoe, a golf shoe, a hiking shoe, a ski or snowboarding boot, a tennis shoe, a running shoe, or a walking shoe. The upper may also be incorporated into a non-athletic shoe, such as a dress shoe, a loafer, or a sandal.

FIG. 1 is an illustration showing an article of footwear 100 formed with an upper 102, where the upper 102 is substantially formed as a textile component, such as a knitted component 130. As shown, the upper 102 may be secured to a sole structure 104. The upper 102 may include a lateral side 106 and a medial side 108. The area where the sole structure 104 joins the upper 102 may be referred to as a biteline 110. The upper 102 may be joined to the sole structure 104 in a fixed manner using any suitable technique, such as through the use of an adhesive, by sewing, etc. The upper 102 may extend partially or completely around a foot of a wearer and/or may be integral with the sole structure 104, and a sockliner may or may not be used. In some embodiments, the sole structure 104 may include a midsole (not shown) and an outsole.

The upper 102 may additionally include a throat area 112 extending from and an ankle opening 114 leading to a void 116, and a collar 118 may at least partially surround the ankle opening 114. The void 116 of the article of footwear 100 may be configured (e.g., sized and shaped) to receive and accommodate a foot of a person. The throat area 112 may be generally disposed in a midfoot area 120 of the upper 102. The midfoot area 120 of the upper 102 may be located between a heel area 122 and a toe area 124. In some embodiments, an optional tongue, such as the depicted tongue 126 may be disposed in the throat area 112. The tongue 126 may be any type of tongue, such as a gusseted tongue or a burrito tongue. If a tongue is not included (or in combination with a tongue), the lateral and medial sides of the throat area 112 may be joined together.

The article of footwear 100 may include a fastening element (not shown). Any suitable type of fastening element may be used, such as a shoelace, a cable-tensioning system, and/or any other suitable device. The upper 102 may be configured to secure to and communicate with the fastening element such that the fastening element may adjust and/or tighten the upper 102 around a foot of a wearer. For example, the upper 102 may include a set of apertures 128 for receiving the fastening element, but other suitable element(s) may alternatively be used.

At least a portion of the upper 102, and potentially substantially the entirety of the upper 102, may be formed of the knitted component 130 (or another suitable textile component). The knitted component 130 may be formed as an integral one-piece element during a knitting process, such as a weft knitting process (e.g., with a flat knitting machine or circular knitting machine), a warp knitting process, or any other suitable knitting process. That is, the knitting process on the knitting machine may substantially form the knit structure of the knitted component 130 without the need for significant post-knitting processes or steps. Alternatively, two or more portions of the knitted component 130 may be formed separately as distinct integral one-piece elements and then the respective elements attached.

Forming the upper 102 with the knitted component 130 may provide the upper 102 with advantageous characteristics including, but not limited to, a particular degree of elasticity (for example, as expressed in terms of Young's modulus), breathability, bendability, strength, moisture absorption, weight, abrasion resistance, and/or a combination thereof. These characteristics may be accomplished by selecting a particular single layer or multi-layer knit structure (e.g., a ribbed knit structure, a single jersey knit structure, etc.), by varying the size and tension of the knit structure, by using one or more yarns formed of a particular material (e.g., a polyester material, a relatively inelastic material, or a relatively elastic material such as spandex), by selecting yarns of a particular size (e.g., denier), and/or a combination thereof. The knitted component 130 may also provide desirable aesthetic characteristics by incorporating yarns having different colors, textures or other visual properties arranged in a particular pattern. The yarns themselves and/or the knit structure formed by one or more of the yarns of the knitted component 130 may be varied at different locations such that the knitted component 130 has two or more portions with different properties (e.g., a portion forming the throat area 112 of the upper 102 may be relatively elastic while another portion may be relatively inelastic). In some embodiments, the knitted component 130 may incorporate one or more materials with properties that change in response to a stimulus (e.g., temperature, moisture, electrical current, magnetic field, or light). For example, the knitted component 130 may include yarns formed of a thermoplastic polymer material (e.g., a polyurethane, polyamide, polyolefin, and/or nylon) that transitions from a solid state to a softened or liquid state when subjected to certain temperatures at or above its melting point and then transitions back to the solid state when cooled. The thermoplastic polymer material may provide the ability to heat and then cool a portion of the knitted component 130 to thereby form an area of bonded or continuous material (herein referred to as a "fused area") that exhibits certain advantageous properties including a relatively high degree of rigidity, strength, and water resistance, for example.

Figure 2:
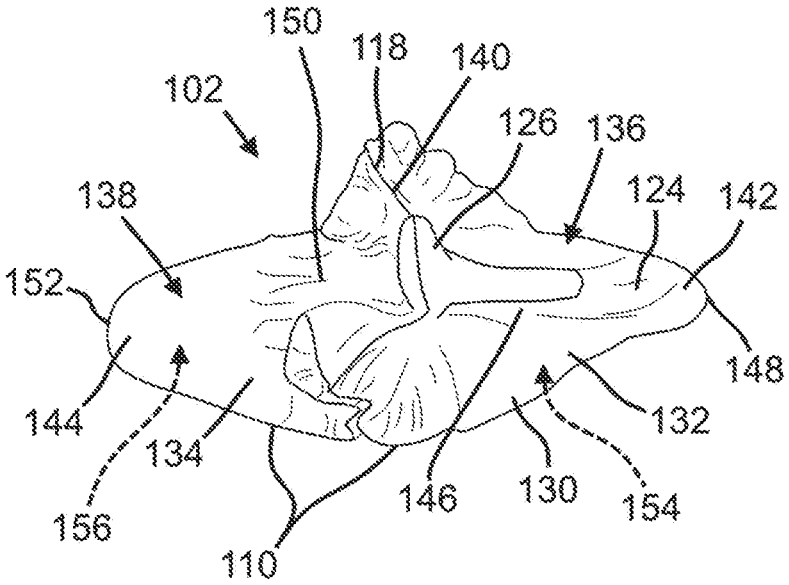
FIG. 2 is an illustration showing the knitted component for the upper depicted in FIG. 1 as it may appear after formation on a knitting machine.

FIG. 2 shows the knitted component 130 of the upper 102 as it may appear after the knitting process (e.g., after leaving a flat-bed knitting machine) but before being manipulated into its wearable shape. The knitted component 130 may include the first portion 132 and a second portion 134, where the outer surface 136 of the upper 102 is at least partially formed by the first portion 132, and where the inner surface 138 of the upper 102 is at least partially formed by the second portion 134. The first portion 132 and the second portion 134 may be formed during a single knitting process (e.g., such that the first portion 132 and the second portion 134 are attached when the knitted component 130 comes off a knitting machine). Thus, the first portion 132 and the second portion 134 may, in some embodiments, share a common yarn, a common course, a common knit stitch or other knit structure, etc. Further, the first portion 132 and the second portion 134 may be secured via at least one knit structure (e.g., a knitted loop) of the knitted component 130. As described in more detail below (with reference to FIG. 3), the unique shape of the upper 102 may advantageously allow the first portion 132 and/or the second portion 134 to each utilize more than one needle bed (e.g., two needle beds of a flat knitting machine) during the formation of the knitted component 130. Thus, once the knitted component 130 is in its wearable shape, the second portion 134 may have a double jersey knit structure. Herein, a "double jersey knit structure" is defined generally as any knit structure formed on two needle beds and utilizing at least one needle from each bed, including (but not limited to) a full rib knit structure, a 1×1, 2×1, and 3×1 rib structure, an interlock knit structure, a half and full cardigan knit structure, a half and full milano structure, etc. Since the second portion 134 and the first portion 132 can each alone utilize both needle beds of the knitting machine, a double jersey structure of the second portion 134 and a double jersey structure of the first portion 132 may be coextensive in the upper 102. Advantageously, since both portions can have double jersey structures (which may be coextensive), the upper 102 has an enhanced ability to provide the first portion 132 and/or the second portion 134 with knit-in visual and/or functional features.

In some embodiments, a connection structure 140, which may include at least one loop or other knit structure of one or more courses formed by one or more passes of a feeder of a knitting machine, may connect and secure the first portion 132 to the second portion 134. The connection structure 140 may extend along the tongue 126 and substantially around the collar 118 as shown (see also FIG. 6), but in other embodiments the connection structure 140 may be limited to the tongue 126 (or a portion of the tongue 126), the collar 118 (or a portion of the collar 118), or any combination thereof. It is also contemplated that the connection structure 140 may be included at a location other than the tongue 126 and the collar 118 (e.g., in the toe area 124 shown by FIG. 1). The first portion 132 may extend from the connection structure 140, to a first midfoot area 146 of the first portion 132, and to a first toe area 142 of the first portion 132. The first portion 132 may terminate at an end 148 of the first toe area 142 in some embodiments. Similarly, the second portion 134 may extend in the opposite direction from the connection structure 140, to a second midfoot area 150, and to a second toe area 144. The second portion 134 may terminate at an end 152 of the second toe area 144 in some embodiments.

Figure 4:
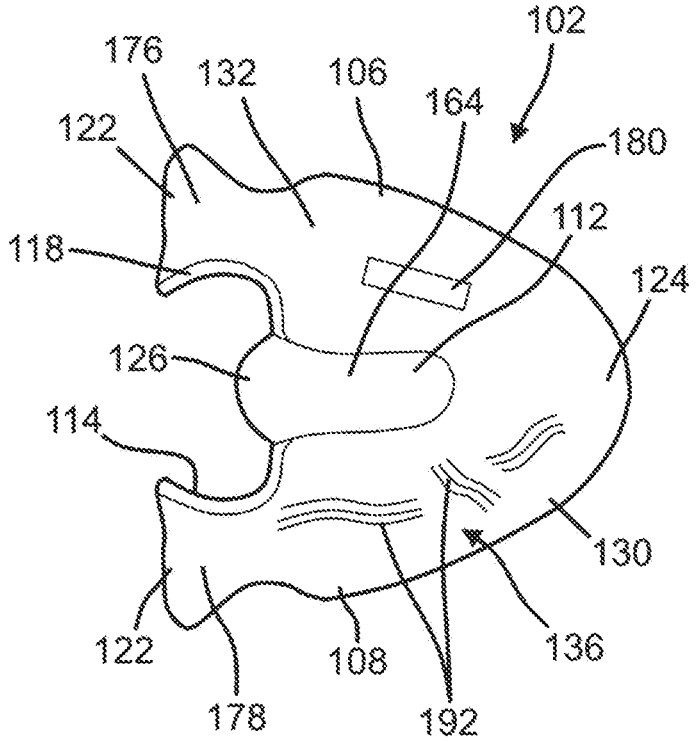
FIG. 4 is an illustration showing a top view of the knitted component of FIG. 2 when folded or otherwise manipulated into a folded state.
Figure 5:
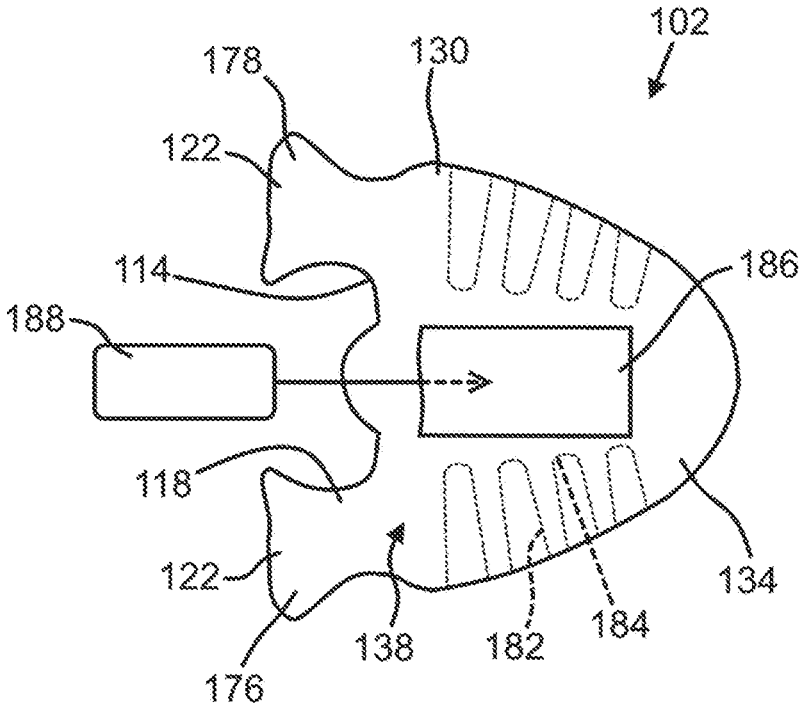
FIG. 5 is an illustration showing a bottom view of the knitted component of FIG. 2 when folded or otherwise manipulated into a folded state.

After the knitting process, the first portion 132 and/or the second portion 134 may be folded or otherwise manipulated such that the first portion 132 forms the outer surface 136 and the second portion 134 forms the inner surface 138 of the upper 102, respectively (or vice versa) (which is shown in FIGS. 4-5). Still referring to FIG. 2, when folding or otherwise manipulating the upper 102 into its wearable shape, the second toe area 144 of the second portion 134 may be manipulated such that it is adjacent to and/or coextensive with the first toe area 142 of the first portion 132. Thus, the first toe area 142 and the second toe area 144 may both be located in the toe area 124 (shown in FIG. 1) when the upper 102 is in its wearable shape. Further, when folding or otherwise manipulating the upper 102 into its wearable shape, one of the first portion 132 and the second portion 134 may be substantially inverted with respect to the other such that a first interstitial surface 154 of the first portion 132 (which may face opposite the outer surface 136) and a second interstitial surface 156 of the second portion 134 (which may face opposite the inner surface 138) face each other and become adjacent to each other.

Optionally, an adhesive or other attachment device may be applied to at least one of the first interstitial surface 154 and the second interstitial surface 156 before or during the folding step such that the first interstitial surface 154 and the second interstitial surface 156 become substantially secured (e.g., fixed) together along at least a portion of their coextensive areas, but an adhesive is not required. In some embodiments, the first portion 132 and the second portion 134 may remain locally unsecured (e.g., not attached along their coextensive portions in a particular area) with respect to one another at least at some locations. Thus, the first portion 132 and the second portion 134 may remain movable (e.g., slidable) with respect to one another, and an interstitial space may be located between the first portion 132 and the second portion 134. In addition to (or as an alternative to) being secured via the knitted connection structure 140, the first portion 132 and the second portion 134 may be secured (e.g., sewn or otherwise secured) along the biteline 110. In other embodiments, the first portion 132 and the second portion 134 may be indirectly secured via a sole structure (e.g., each independently secured to the sole structure 104 shown in FIG. 1).

Optionally (and as described in more detail below), an insert or other object may be positioned between the first portion 132 and the second portion 134 for providing the upper 102 with certain functional or visual characteristics. Advantageously, the insert may be substantially permanently located between portions of the upper 102 such the insert is substantially inaccessible to a user during typical use. Thus, the interstitial space may be advantageous for holding certain components that are not intended for user access (e.g., electronic sensors or other electronic components, moisture-sensitive components (particularly when at least one of the first portion 132 and the second portion 134 is waterproof), foams or materials that may be harmful to humans or pets, etc.).

Figure 3:
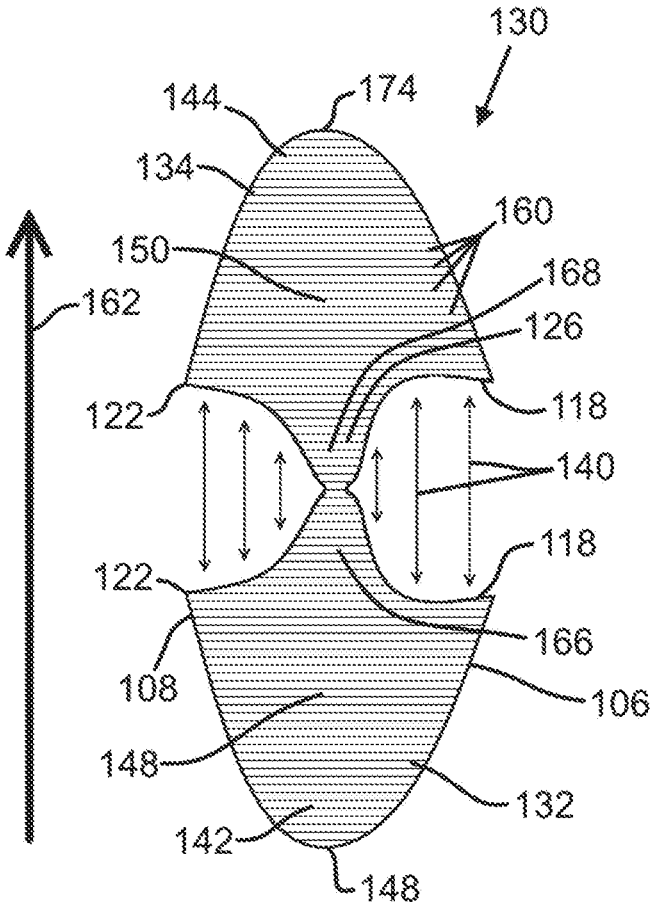
FIG. 3 is a diagram illustrating an embodiment of a knitting process for forming the knitted component depicted in FIG. 1.

FIG. 3 is a diagram ("the knit diagram") illustrating an embodiment of a knitting process (e.g., a sequence of knitting on a flat knitting machine) for forming the knitted component 130 of FIG. 2. The labeled locations of FIG. 3 correspond with the labeled elements of FIG. 2. Each horizontal line 160 may represent a course, a certain number of courses, and/or other types of structures formed on a knitting machine during a pass of a feeder (e.g., an inlay). The knitting sequence may be performed in the direction depicted by the arrow 162 such that the knitted component moves with respect to a needle bed in a direction opposite the direction depicted by the arrow 162. The first portion 132 of the knitted component 130 may be knitted first, followed by the second portion 134 as shown (or vice versa).

The first toe area 142 of the first portion 132 may include the first course formed on the knitting machine (e.g., a course at the terminal end 148 of the first toe area 142). Moving along the direction of the large bolded arrow 162 in FIG. 3, the knitting machine may continue from the first toe area 142 of the first portion 132 to the first midfoot area 146 of the first portion 132 and then approach the connection structure 140. As shown, courses 160 forming the knitted component 130 may extend in the medial-to-lateral and lateral-to-medial directions. At least a portion of the courses 160 may utilize two needle beds of the knitting machine (e.g., for forming a double-jersey knit structure or another suitable structure utilizing two beds), but the knitted component may have certain areas with courses formed on only one bed. The particular knitting direction of FIG. 3 is not necessarily required, and it is contemplated that courses 160 may extend in another direction (e.g., a direction perpendicular to the depicted direction, a direction diagonal with respect to the depicted direction, etc.). However, the knitting direction of FIG. 3 may provide the ability to form the connection structure 140 along a shaped, non-linear contour (e.g., along the collar 118 and/or the tongue 126).

For example, the connection structure 140 may be formed using a technique where, as the pattern narrows, the knitting machine holds outer loops on needles of a needle bed for a certain number of courses until the pattern again widens. In the specific example of FIG. 3, when the knitting machine reaches a heel area 122 of the collar 118 (on at least one of the medial side 108 and the lateral side 106), the needles used for forming loops of the collar 118 may continue to hold those loops (e.g., without knitting other yarns) during knitting of a first tongue area 166 of the first portion 132.

Similarly, as the first tongue area 166 narrows, outer loops of the first tongue area 166 may be held as the knitting machine continues along the first tongue area 166 in the knitting direction. When the knitting machine reaches the second portion 134, the held loops may be re-incorporated into a new course 160 as the second tongue area 168 widens. Similarly, the held loops of the collar 118 of the first portion 132 may be re-incorporated into new courses when the collar 118 of the second portion 134 is formed. The holding-and-re-incorporating technique may form the connection structure 140, which is represented in FIG. 3 by the small arrows indicating held and re-incorporated loops.

The knitting machine may then continue to knit the second portion 134 by knitting the second midfoot area 150 of the second portion 134 and then the second toe area 144 of the second portion 134. The terminal end 174 of the second toe area 144 may be the final course formed on the knitting machine. While the knitting process is generally described with reference to FIG. 3 as starting with the first portion 132 and ending with the second portion 134.

FIG. 4 is an illustration showing the knitted component 130 forming the upper 102 when folded or otherwise manipulated into a folded state. The second portion 134 (FIG. 2) may be coextensive with the first portion 132 and blocked from view by the first portion 132 from the perspective of FIG. 4, as depicted. Advantageously, the second portion 134 may include one or more knit or non-knit functional features (as described in more detail below) that provide the upper 102 with functional advantages without sacrificing aesthetic appeal, particularly when the first portion 132 is configured to provide desirable aesthetics. However, it is contemplated that the second portion 134 may have portions that extend beyond the coverage of the first portion 132 in other embodiments (for example, when the first portion 132 and the second portion 134 have different shapes and/or when the upper 102 has certain portions formed by only one of the first portion 132 and the second portion 134). Once folded, the upper may include heel area 122 with a lateral heel area 176 and a medial heel area 178 configured to secure together, and a collar 118 may be configured to wrap around the ankle opening 114.

As described above, the first portion 132 may form the outer surface 136 of the upper 102. Thus, it may be desirable to provide the outer surface 136 with a particular knit structure and/or particular materials (e.g., yarn types) for suitable anti-abrasiveness to enhance the durability of the upper 102. Optionally, the first portion 132 may have a relatively low elasticity when compared with the second portion 134 to provide the upper 102 with a shell-like structure to provide the upper 102 with suitable strength, rigidity, and durability, and/or to provide protection to a wearer's foot.

Further, the outer surface 136 may be visible when the upper 102 is in use in an article of footwear. Thus, it may be desirable for the outer surface 136 to include one or more ornamental elements 192. In some embodiments, the ornamental elements 192 may be formed during the knitting process by incorporating yarns of different colors or other visual effects in a particular pattern. The first portion 132 may advantageously be formed with courses utilizing two needle beds (e.g., two needle beds of a flat knitting machine), which may enhance the ability to include certain knit features, including desirable visual effects. Further, certain area of the first portion 132, such as the first throat area 164, may include at least two separable layers with a pocket therebetween formed by a tubular knit structure, for example, or another suitable technique (which may be more easily accomplished when using two needle beds). Advantageously, an insert may be placed into the pocket. Additionally or alternatively, certain areas of the first portion 132 may have different mechanical characteristics than other areas, which also may be more easily and/or better accomplished when two needle beds are available when forming the first portion 132. In some embodiments, for example, the throat area 112 of the first portion 132 may be more elastic than other areas of the first portion 132 (e.g., the medial side 108, the lateral side 106, the heel area 122, and/or the toe area 124), which may facilitate receipt of a foot in the void of the upper 102, a snug and comfortable fit of the upper 102, and/or suitable communication with a fastening system, while still providing desirable rigidity, durability, and support areas in desirable areas.

Optionally, the first portion 132 may include a window 180 such that a viewer from the perspective of FIG. 4 can view the second portion 134 through the window 180. The window 180 may be desirable visually by allowing a viewer to see a color contrast or other visual contrast between the first portion 132 and the window-exposed area of the second portion 134. It is contemplated that the window 180 may provide a dynamic visual effect if the first portion 132 moves relative to the second portion 134 when the article of footwear is in use (e.g., when a wearer is walking or otherwise performing an activity that displaces the first portion 132 with respect to the second portion 134 at the window 180). The window 180 may have any suitable structure, and in some particular embodiments the window 180 may incorporate monofilament strands as described in U.S. patent application Ser. No. 14/026,531, filed Sep. 13, 2013, and published as U.S. 2015/0075031, which is herein incorporated by reference in its entirety.

The first portion 132 may additionally or alternatively incorporate functional elements for providing mechanical and/or other physical properties to the first portion (including any of the functional elements described with respect to the second portion 134 with reference to FIG. 5). For example, the first portion 132 may incorporate a cushioning element in the first throat area 164, the collar 118, and/or the tongue 126, as shown. In some embodiments, the cushioning element may be provided by bulking yarns, which may be inlaid and/or floated within the first portion 132, particularly when two needle beds are used when forming the first portion 132 (which may facilitate the inlaying process). Bulking yarns are described in U.S. Provisional Patent Application No. 62/355,153, filed Jun. 27, 2016, which is herein incorporated by reference in its entirety. Bulking yarns may additionally or alternatively be included in the second portion 134.

FIG. 5 is an illustration showing a bottom view of the knitted component of FIG. 2 when folded or otherwise manipulated into a folded state. The first portion 132 (shown in FIG. 2 and FIG. 4) may be coextensive with the second portion 134 and blocked from view by the second portion 134 from the bottom view of FIG. 4, as depicted. However, it is contemplated that the first portion 132 may have areas that extend beyond the coverage of the second portion 134 in other embodiments (for example, when the first portion 132 and the second portion 134 have different shapes and/or when the upper 102 has certain portions formed by only one of the first portion 132 and the second portion 134). As described above, once folded, the upper may include the heel area 122 with a lateral heel area 176 and a medial heel area 178 configured to secure together, and a collar 118 may be configured to wrap around the ankle opening 114 to form a collar 118 (as described with reference to FIG. 6).

The second portion 134 may form the inner surface 138, which may face and/or define the void when the upper 102 is incorporated into an article of footwear. Thus, while the second portion 134 may include any or all of the features described above with respect to the first portion 132, it may be particularly desirable for the second portion 134 to include materials and/or knit structures suitable for contacting the foot (or sock) of a wearer. For example, the second portion 134 may be substantially formed of polyester yarns, which may give it comfort-related characteristics particularly well-suited for contact with a foot. Further, the second portion 134 may be formed with particular materials and/or knit structures such that it is more elastic than the first portion, thereby providing a desirable retention and a snug-feeling fit to the wearer. Like the first portion 132, the second portion 134 may include different areas with different mechanical properties (e.g., different elasticities).

The second portion 134 may additionally or alternatively incorporate other functional elements, such as the tensile strand 182. The tensile strand 182 may be inlaid within the knit structure of the knitted component 130 and may be configured (e.g., with a suitable rigidity and tensile strength) to provide additional support and stability in the medial-to-lateral direction, particularly when in communication with a fastening system (e.g., a shoelace). The tensile strand 182 may form loops 184 in the throat area (which may surround and/or form lace apertures) configured to receive the fastening system, as shown. Some embodiments of tensile strands 182 that may be used are describe in U.S. Patent Application Publication No. 2015/0359290, U.S. Patent Application Publication No. 2014/0237861, and U.S. Pat. No. 9,145,629, which are herein incorporated into the present application in their entireties.

Further, the second portion 134 may optionally include at least one pocket 186 for receiving an insert 188. The pockets 186 may be formed by utilizing a tubular knit structure or another suitable knit structure for providing two separable layers when forming the second portion 134. The insert 188 may then be permanently or temporarily placed within the pocket 186 to provide cushioning, rigidity, protection, durability, etc. The first portion 132 described above may also (or alternatively) include a pocket and insert.

Advantageously, since the second portion 134 may be hidden from typical view by the first portion 132 when the upper 102 is in use, the second portion 134 may incorporate one or more functional characteristics or features without regard their effect on the visual appeal of the upper 102. For example, if a particular insert/pocket combination or other element is generally received negatively from an aesthetic perspective, the element can be at least partially hidden from view by the first portion 132 of the knitted component.

Figure 6:
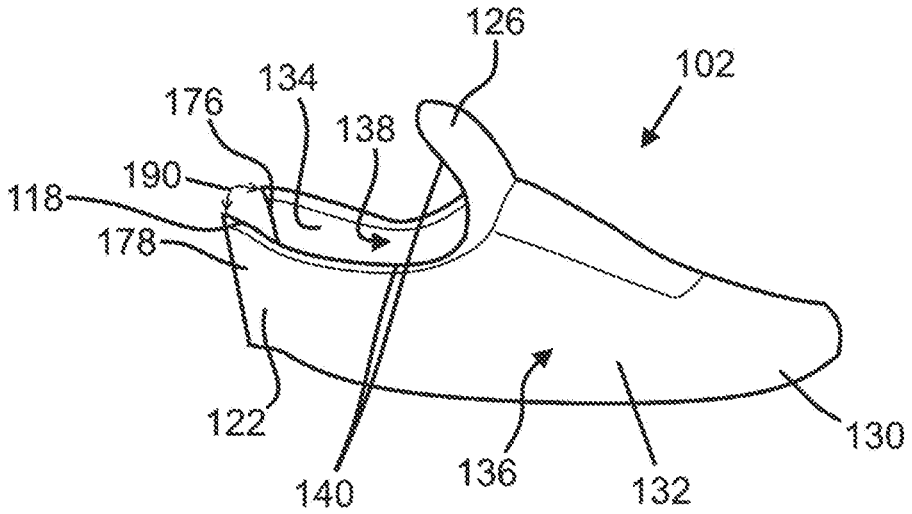
FIG. 6 is an illustration showing the upper of FIG. 2 being folded or otherwise manipulated into a wearable shape.
Figure 7:
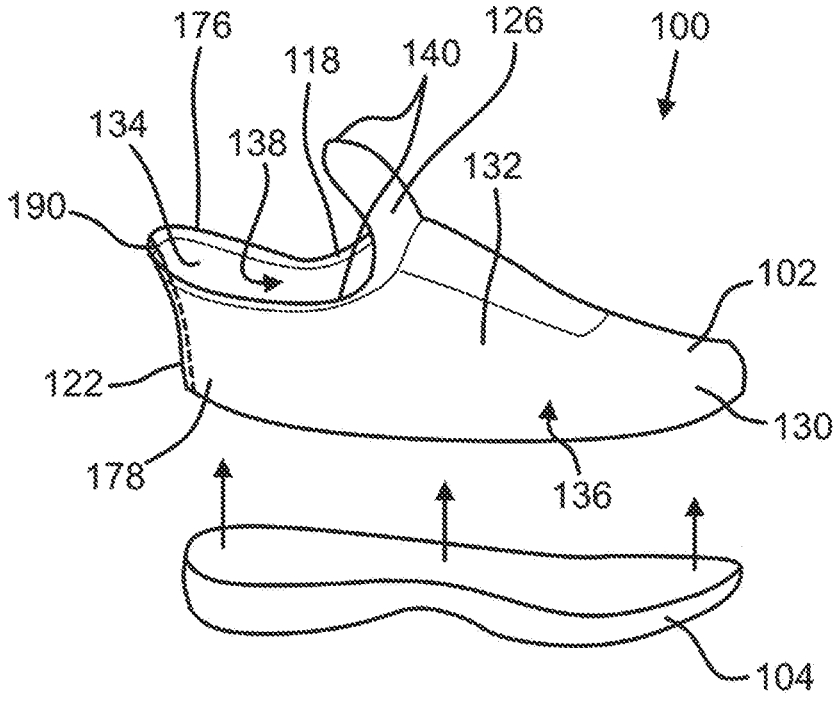
FIG. 7 is an illustration showing the upper being secured to a sole structure after the folding process of FIG. 6.

FIG. 6 is an illustration showing the knitted component 130 of the upper 102 being folded or otherwise manipulated into a wearable shape, and FIG. 7 shows the manipulated upper 102 being secured to a sole structure 104. As shown in FIGS. 6-7, the outer surface 136 formed by the first portion 132 may face outwards, and the inner surface 138 formed by the second portion 134 may face inwards. The connection structure 140 connecting the first portion 132 to the second portion 134 may extend at least partially around the collar 118 and/or along the tongue 126. The lateral heel area 176 and the medial heel area 178 may be coupled at this step to form a seam 190 in the heel area 122. Connecting the lateral heel area 176 to the medial heel area 178 at the seam 190 may include sewing, adhesive bonding, heat bonding, welding, using a mechanical clamp, or any other suitable device or method, and it is contemplated that another device may be placed between the medial heel area 178 and the lateral heel area 176. The folding/manipulating step, and/or the step of forming the seam 190, may be at least partially performed when the upper 102 is located on a last. An example of a last and an associated lasting process is described in U.S. patent application Ser. No. 12/848,352, filed Aug. 2, 2010, and issued as U.S. Pat. No. 8,595,878, which is herein incorporated by reference in its entirety. FIG. 7 depicted the upper 102 being secured to the sole structure 104 to complete (or substantially complete) the manufacturing process of the article of footwear 100.

FIG. 8 is an illustration showing the upper 102 of FIG. 2 when incorporated into the article of footwear 100 with hidden elements shown in dashed lines. As depicted, the upper 102 may include certain functional elements, such as the tensile strand 182, pockets 186 with inserts 188, fused areas of thermoplastic polymer material, and/or any other suitable functional element. However, as shown in FIG. 9, the functional elements may be hidden from view when desired. The article of footwear may include the ornamental elements 192 for enhancing the visual appearance of the article of footwear. The present embodiments are particularly advantageous since at least one of, and potentially both of, the first portion 132 and the second portion 134 of the knitted component 130 may be formed with the full capabilities of two needle beds of a knitting machine for providing such functional and ornamental characteristics, which may be accomplished due to the unique shape of the knitted component as described herein.

As shown in FIGS. 8-9, it is contemplated that the tensile strands 182, if included, may extend from the outer surface 136 such that they are visible when the article of footwear 100 is in use. Advantageously, the loops 184 may be accessible by a user and/or in communication with a fastening system located adjacent to the outer surface 136. Slots 196 in the first portion 132 may be included for receiving the loops 184 of the tensile strands 182, as shown. The loops 184 may communicate with (e.g., surround) the optional apertures 128.

In the present disclosure, the ranges given either in absolute terms or in approximate terms are intended to encompass both, and any definitions used herein are intended to be clarifying and not limiting. Notwithstanding that the numerical ranges and parameters setting forth the broad scope of the present embodiments are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges (including all fractional and whole values) subsumed therein.

Furthermore, the present disclosure encompasses any and all possible combinations of some or all of the various aspects described herein. It should also be understood that various changes and modifications to the aspects described herein will be apparent to those skilled in the art. Such changes and modifications can be made without departing from the spirit and scope of the present disclosure and without diminishing its intended advantages. It is therefore intended that such changes and modifications be covered by the appended claims.

What is claimed is:

1. A knitted component forming a heel area and a tongue portion of an upper of an article of footwear, the knitted component comprising:

a first knitted portion that forms part of an outer surface of the heel area and the tongue portion of the upper, the first knitted portion comprising a double jersey knit structure, and the first knitted portion including an inlaid bulking yarn;

a second knitted portion that forms part of an inner surface of the heel area and the tongue portion of the upper, the second knitted portion at least partially coextensive with the first knitted portion, wherein the first knitted portion and the second knitted portion are formed as an integral one-piece knitted element, wherein the first knitted portion and the second knitted portion are connected by a knitted connection structure that is at least partially coextensive with an intersection of the first knitted portion and the second knitted portion, wherein the knitted connection structure is located at the tongue portion of the upper, wherein the first knitted portion and the second knitted portion are folded about the knitted connection structure into a folded state; and an interstitial space located between the first knitted portion and the second knitted portion, wherein the upper includes a lateral heel area and a medial heel area connected at a heel seam.

2. The knitted component of claim 1, wherein the first knitted portion includes a first plurality of courses, wherein the second knitted portion includes a second plurality of courses, and wherein the knitted connection structure is located between the first plurality of courses and the second plurality of courses.

3. The knitted component of claim 2, wherein at least one course of the first plurality of courses and at least one course of the second plurality of courses includes a double jersey knit structure.

4. The knitted component of claim 1, wherein one of the first knitted portion and the second knitted portion is inverted with respect to the other of the first knitted portion and the second knitted portion.

5. The knitted component of claim 1, wherein a connection of the lateral heel area and the medial heel area is sewn, adhesively bonded, or heat bonded.

6. The knitted component of claim 1, wherein the knitted connection structure further extends along an ankle collar of the upper.

7. The knitted component of claim 1, wherein at least one of the first knitted portion and the second knitted portion includes an inlaid tensile strand that is distinct from the inlaid bulking yarn.

8. A knitted component forming a heel area and a tongue portion of an upper of an article of footwear, the knitted component comprising:

a first knitted portion that forms an outer surface of the heel area and the tongue portion of the upper, the first knitted portion comprising a double jersey knit structure;

a second knitted portion that forms an inner surface of the heel area and the tongue portion of the upper, the second knitted portion at least partially coextensive with the first knitted portion, wherein the first knitted portion and the second knitted portion are formed as an integral one-piece knitted element, wherein the first knitted portion and the second knitted portion are connected by a knitted connection structure that is at least partially coextensive with an intersection of the first knitted portion and the second knitted portion, wherein the knitted connection structure is located at the tongue portion of the upper, wherein the first knitted portion and the second knitted portion are folded about the knitted connection structure into a folded state; and an interstitial space located between the first knitted portion and the second knitted portion, wherein the upper includes a lateral heel area and a medial heel area that are connected at a heel seam.

9. The knitted component of claim 8, wherein the first knitted portion includes a first plurality of courses, wherein the second knitted portion includes a second plurality of courses, and wherein the knitted connection structure is located between the first plurality of courses and the second plurality of courses.

10. The knitted component of claim 9, wherein at least one course of the first plurality of courses and at least one course of the second plurality of courses includes a double jersey knit structure.

11. The knitted component of claim 8, wherein one of the first knitted portion and the second knitted portion is inverted with respect to the other of the first knitted portion and the second knitted portion.

12. The knitted component of claim 8, wherein a connection of the lateral heel area and the medial heel area is sewn, adhesively bonded, or heat bonded.

13. The knitted component of claim 9, wherein the knitted connection structure extends along an ankle collar of the upper.

14. The knitted component of claim 8, wherein at least one of the first knitted portion and the second knitted portion includes an inlaid tensile strand.

15. An article of footwear with an upper comprising a knitted component that forms at least a heel area and a tongue portion of the upper, the knitted component comprising:

a first knitted portion that forms at least part of an outer surface of the heel area and the tongue portion of the upper, the first knitted portion comprising a double jersey knit structure, and the first knitted portion including an inlaid bulking yarn;

a second knitted portion that forms an inner surface of the heel area and the tongue portion of the upper, the second knitted portion at least partially coextensive with the first knitted portion, wherein the first knitted portion and the second knitted portion are formed as an integral one-piece knitted element, wherein the first knitted portion and the second knitted portion are connected by a knitted connection structure that is at least partially coextensive with an intersection of the first knitted portion and the second knitted portion, wherein the knitted connection structure is located at least at the tongue portion of the upper, wherein the first knitted portion and the second knitted portion are folded about the knitted connection structure into a folded state; and an interstitial space located between the first knitted portion and the second knitted portion, wherein the upper includes a lateral heel area and a medial heel area that are connected at a heel seam.

16. The article of footwear of claim 15, wherein one of the first knitted portion and the second knitted portion is inverted with respect to the other of the first knitted portion and the second knitted portion.

17. The article of footwear of claim 15, wherein a connection of the lateral heel area and the medial heel area is sewn, adhesively bonded, or heat bonded.

18. The article of footwear of claim 15, wherein the knitted connection structure further extends along an ankle collar of the upper.

* * * * *